US008875638B2

(12) United States Patent
Luis y Prado

(10) Patent No.: US 8,875,638 B2
(45) Date of Patent: Nov. 4, 2014

(54) SECURING LOADS TO PALLETS

(71) Applicant: Workshops for Warriors, San Diego, CA (US)

(72) Inventor: Hernán Luis y Prado, San Diego, CA (US)

(73) Assignee: Workshops for Warriors, San Diego, CA (US)

( * ) Notice: Subject to any disclaimer, the term of this patent is extended or adjusted under 35 U.S.C. 154(b) by 0 days.

(21) Appl. No.: 13/944,690

(22) Filed: Jul. 17, 2013

(65) Prior Publication Data

US 2014/0069305 A1 Mar. 13, 2014

Related U.S. Application Data

(60) Provisional application No. 61/700,594, filed on Sep. 13, 2012.

(51) Int. Cl.
*B65D 19/38* (2006.01)
*B65D 19/00* (2006.01)

(52) U.S. Cl.
CPC ..... *B65D 19/0012* (2013.01); *B65D 19/0046* (2013.01); *B65D 2519/00024* (2013.01); *B65D 2519/00059* (2013.01); *B65D 2519/00094* (2013.01); *B65D 2519/00273* (2013.01); *B65D 2519/00288* (2013.01); *B65D 2519/00323* (2013.01); *B65D 2519/00373* (2013.01); *B65D 2519/00562* (2013.01); *B65D 2519/00815* (2013.01)
USPC ..... 108/55.5; 108/57.33

(58) Field of Classification Search
CPC ..... B65D 19/44; B65D 19/00308; B65D 19/00363; B65D 19/00004; B65D 2519/00288; B65D 2519/00034; B65D 2519/00069
USPC ..... 108/55.3, 55.5, 51.11, 55.1, 57.25, 108/57.33
See application file for complete search history.

(56) References Cited

U.S. PATENT DOCUMENTS

| | | | | | |
|---|---|---|---|---|---|
| 2,696,360 | A | * | 12/1954 | Roger | 206/597 |
| 3,606,844 | A | * | 9/1971 | Lubker, II et al. | 108/57.28 |
| 4,614,277 | A | * | 9/1986 | Fourie et al. | 217/43 A |
| 4,829,909 | A | * | 5/1989 | Mandel | 108/55.5 |
| 4,890,560 | A | * | 1/1990 | Good | 108/53.1 |
| 5,358,137 | A | * | 10/1994 | Shuert et al. | 220/485 |
| 5,413,052 | A | | 5/1995 | Breezer | |
| 5,720,229 | A | * | 2/1998 | Schrage | 108/55.5 |

(Continued)

OTHER PUBLICATIONS

Authorized Officer L. Tsoban, Notification of Transmittal of the International Search Report and the Written Opinion of the International Searching Authority, International Application No. PCT/US2013/050900, mailed Nov. 21, 2013, 6 pages.

*Primary Examiner* — Jose V Chen
(74) *Attorney, Agent, or Firm* — Fish & Richardson P.C.

(57) ABSTRACT

A pallet, a method of securing a load to a pallet, and a method of manufacturing therefor, in which the pallet includes a top plate, a base structure, and support legs, at least a portion of which join the top plate and the base structure. The support legs are disposed between the top plate and the base structure in an arrangement that accommodates engagement of the pallet with a standard jacking device along any edge of the pallet. Securing slots extend through the top plate, wherein a first subset of the securing slots is oriented lengthwise parallel to a first edge of the top plate and a second subset of the securing slots is oriented lengthwise perpendicular to the first edge of the top plate.

20 Claims, 6 Drawing Sheets

(56) References Cited

U.S. PATENT DOCUMENTS

| | | | | |
|---|---|---|---|---|
| 6,065,916 | A * | 5/2000 | Swensen | 410/97 |
| 6,101,955 | A * | 8/2000 | Salce | 108/51.11 |
| 6,199,488 | B1 * | 3/2001 | Favaron et al. | 108/57.25 |
| 6,234,087 | B1 | 5/2001 | Brown | |
| 6,283,044 | B1 | 9/2001 | Apps | |
| 6,422,795 | B2 * | 7/2002 | Holt et al. | 410/115 |
| 6,524,040 | B1 * | 2/2003 | Heil | 410/67 |
| 6,622,642 | B2 * | 9/2003 | Ohanesian | 108/57.25 |
| 6,712,567 | B2 * | 3/2004 | Hsu | 410/46 |
| 6,807,910 | B2 * | 10/2004 | Apps | 108/57.25 |
| 6,840,181 | B2 * | 1/2005 | Smyers | 108/56.1 |
| 6,905,021 | B2 | 6/2005 | Polumbaum | |
| 6,986,309 | B2 * | 1/2006 | Sugihara et al. | 108/57.25 |
| 7,007,613 | B2 | 3/2006 | Sketo | |
| 7,555,879 | B1 * | 7/2009 | Utz et al. | 53/410 |
| 7,841,281 | B2 * | 11/2010 | Valentinsson | 108/57.25 |
| 8,336,465 | B2 * | 12/2012 | Poulsen et al. | 108/55.1 |
| 8,522,694 | B2 * | 9/2013 | Linares | 108/57.25 |
| 2003/0075082 | A1 | 4/2003 | Apps | |
| 2009/0090281 | A1 | 4/2009 | Huettner et al. | |

* cited by examiner

SECURING LOADS TO PALLETS

CROSS REFERENCE TO RELATED APPLICATIONS

This application claims the benefit under 35 U.S.C. §119 (e)(1) of U.S. Provisional Patent Application No. 61/700,594, filed on Sep. 13, 2012, which is incorporated by reference herein.

TECHNICAL FIELD

This specification relates to pallets, such as pallets used in the transport and storage of industrial equipment, supplies, or the like.

BACKGROUND

Also sometimes referred to as a "skid," a pallet is a flat transport structure that supports a load in a stable fashion while being lifted by a forklift, pallet jack, front loader or other jacking device. In general, a pallet is the structural foundation of a unit load, which allows handling, usage, and storage efficiencies. A load placed on a pallet often is secured to the pallet with straps, stretch wrap, or shrink wrap. Most pallets are wooden, but depending on the application, a pallet can be constructed of other materials such as plastic, metal, or paper, each material having advantages and disadvantages relative to the others.

Certain loads (e.g., large precision instruments, weaponry, ammunition, multiple payloads on one pallet, or industrial machinery), may be very heavy, unbalanced, delicate, and/or awkward. Consequently, such loads are typically rigged with wooden blocking, dunnage, and straps. These techniques are costly, time-intensive, and rely on operator skill to be performed safely and repeatedly. A successful palletization results in a load being secured to the pallet in a manner that prevents any substantial relative movement between the load and the pallet (in view of the load's delicacy).

SUMMARY

This specification describes a pallet system, sometimes referred to herein as a SMISS (Secure Material Integrated Storage System), defining securing slots of varying orientation, a method of securing a load to the pallet system, and a method of manufacturing therefor, that can be used, among other purposes, to securely hold and support industrial equipment during storage, during use, and in transport.

In one aspect, a pallet (for example, a pallet made of steel or aluminum) includes a top plate, a base structure spaced apart from the top plate, and multiple support legs, that are attached to the top plate at respective first ends, at least a portion of the multiple support legs being attached to the base structure at respective second ends. The multiple support legs are disposed between the top plate and the base structure in an arrangement that accommodates engagement of the pallet with a standard jacking device along any edge of the pallet. The top plate defines multiple securing slots extending through the top plate, wherein a first subset of the multiple securing slots are oriented lengthwise parallel to a first edge of the top plate and a second subset of the multiple securing slots are oriented lengthwise perpendicular to the first edge of the top plate.

In another aspect, a method of securing a load to a pallet includes placing a load atop a surface of a pallet, securing the load to the pallet using a first set of one or more securing members, and further securing the load to the pallet using a second set of one or more securing members. The pallet includes a top plate, a base structure spaced apart from the top plate, and a multiple support legs that are attached to the top plate at respective first ends, at least a portion of the multiple support legs being attached to the base structure at respective second ends, the multiple support legs being disposed between the top plate and the base structure in an arrangement that accommodates engagement of the pallet with a standard jacking device along any edge of the pallet. The top plate defines multiple securing slots extending through the top plate, wherein a first subset of the multiple securing slots is oriented lengthwise parallel to a first edge of the top plate and a second subset of the multiple securing slots is oriented lengthwise perpendicular to the first edge of the top plate.

In another aspect, a method of manufacturing a pallet includes forming a top plate defining multiple securing slots and joining the top plate with a base structure via multiple support legs. The first subset of the multiple securing slots is oriented lengthwise parallel to a first edge of the top plate, and a second subset of the multiple securing slots is oriented lengthwise perpendicular to the first edge of the top plate. The multiple support legs are disposed between the top plate and the base structure in an arrangement that accommodates engagement of the pallet with a standard jacking device along any edge of the pallet.

The pallet, the method of securing a load to a pallet, and the method of manufacturing a pallet may include one or more of the following features.

In some examples, the pallet is made of at least one of steel and aluminum. In some examples, the top plate is rectangular in shape with approximate dimensions of one of the following: 48 inches by 40 inches, 48 inches by 48 inches, 60 inches by 36 inches, 36 inches by 36 inches, and 24 inches by 24 inches.

In some examples, the base structure is formed essentially as a rectangular plate defining a central void (e.g., a circular or rectangular opening).

In some examples, the central void has a circular or rectangular shape.

In some examples, the multiple support legs include nine posts. The posts may take on various shapes, e.g., either square, rectangular or cylindrical in shape.

In some examples, more than one but fewer than all of the posts join the base structure to the top plate.

In some examples, four of the nine posts are disposed near respective corners of the top plate and another four of the nine posts are disposed near midpoints of respective edges of the top plate.

In some examples, at least one of the nine posts is affixed to the top plate and extends into a central void defined by the base structure.

In some examples, each of the multiple securing slots has a length that is greater than a width of the respective securing slot.

In some examples, each of the multiple securing slots is rectangular in shape, having a length dimension of about two inches and a width dimension of about 0.5 inch.

In some examples, the first subset of the multiple securing slots includes at least eight rows of securing slots evenly spaced across the top plate.

In some examples, the second subset of the multiple securing slots includes at least seven rows of securing slots evenly spaced across the top plate.

In some examples, the second subset of the multiple securing slots is oriented perpendicular to the first subset of the multiple securing slots.

In some examples, the pallet is configured to support a load of up to about 25 tons.

In some examples, placing the load atop the surface of the pallet includes placing the load atop the top plate of the pallet.

In some examples, the first set of one or more securing members includes a first strap.

In some examples, the second set of one or more securing members includes a second strap.

In some examples, securing the load to the pallet using the first set of one or more securing members includes passing the first strap through a slot of the first subset of the multiple securing slots or through a slot of the second subset of the multiple securing slots.

In some examples, securing the load to the pallet using the second set of one or more securing members includes passing the second strap through a different slot of the first subset of the multiple securing slots or through a different slot of the second subset of the multiple securing slots.

In some examples, passing the second strap through the different slot includes orienting the second strap approximately perpendicular to the first strap.

In some examples, either or both of the first and second sets of one or more securing members includes a securing bolt.

In some examples, the method of manufacturing the pallet further includes joining a central support leg to the top plate such that the central support leg extends downward from the top plate and through a central void defined by the base structure.

Particular implementations of the subject matter described in this specification may be configured to realize various potential advantages. For example, by constructing a pallet having securing slots of varying orientation (e.g., some securing slots that are parallel to one of the pallet's edges and other slots that are perpendicular to that same edge), loads can be secured with an appropriate securing mechanism (e.g., straps and/or bolts) to the pallet in a more convenient and secure manner. In addition, by disposing multiple varying orientated slots across the load bearing surface of the pallet, loads of many different sizes and shapes—including loads of irregular shapes or sizes—can easily and conveniently be accommodated, that is, securely fastened to the pallet. Another potential advantage is that several payloads can be attached to a pallet as the slot configuration allows them to each be secured independent of the other load, whereas a conventional pallet would tend to squeeze all material together, potentially damaging the material that is to be secured.

Another potential advantage of the SMISS slot system is that bolts can be used to secure a variety of different loads without having to spend time and energy drilling holes. The securing slots allow the use of bolts to secure equipment securely and repeatedly to the pallet for transportation and use. For example, a bandsaw can be securely attached to the SMISS and can more easily be moved around a shop or production environment while still being stable enough to be used.

Details of one or more implementations of the subject matter described in this specification are set forth in the accompanying drawings and the description below. Other features, aspects, and potential advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
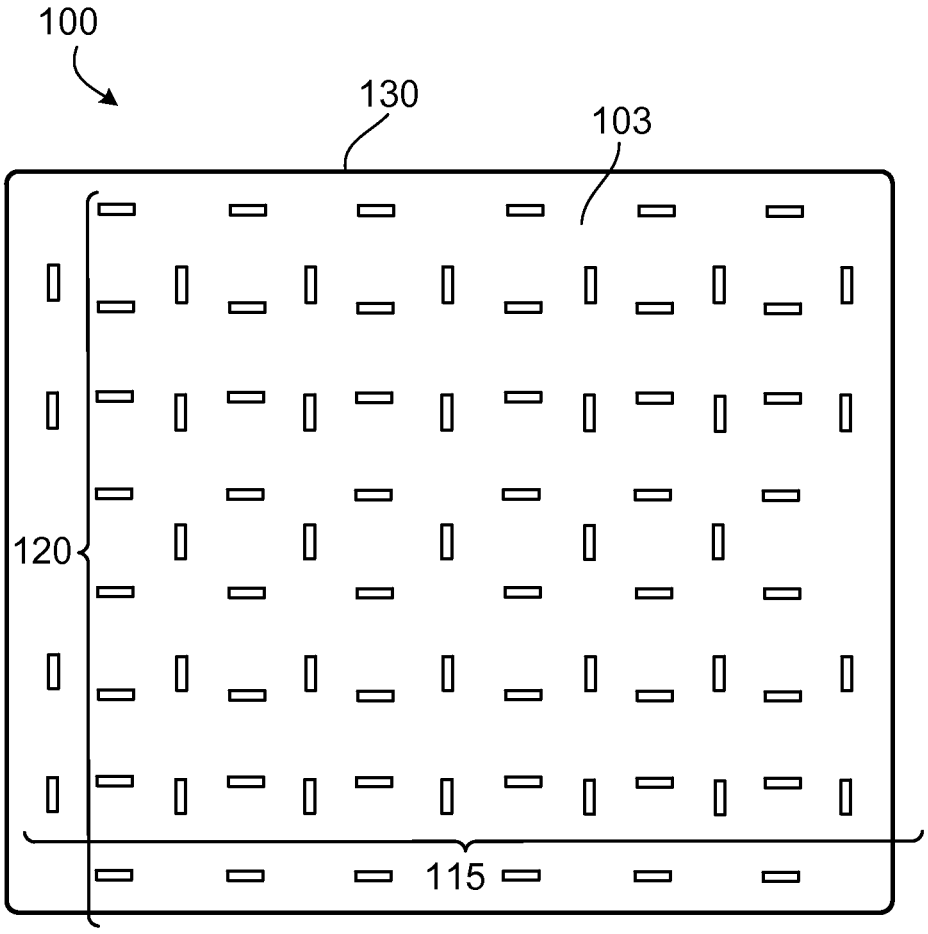
FIG. 1 is top view of a pallet.

FIG. 1 is a top view of a pallet 100. The pallet 100 includes a rectangular top plate 103 which as shown is 40 inches in one dimension and 48 inches in the other dimension. Either or both of the top plate 103 and a cross-sectional area of the pallet 103 may take on other shapes (e.g., square, round or triangular) and/or sizes depending on the desired application. For example, in other implementations, the top plate 103 can have approximate dimensions of 48 inches by 48 inches, 60 inches by 36 inches, 36 inches by 36 inches, or 24 inches by 24 inches. As shown in this example, the top plate 103 has eighty securing slots 105, each of which has a length dimension (e.g., about 2 inches) that is greater than a width dimension (e.g., about 0.5 inches). In general, the securing slots 105 are appropriately sized and shaped to receive and appropriately accommodate mechanisms that may be used to secure a load to the pallet 100—for example, either or both of securing bolts and/or the majority of metal and plastic strapping and banding material known to those skilled in the art can be used (½", ⅝" ¾" 1", 1¼", 1½" and 2" thick). As shown, the slots 105 are arranged in orientations that vary from each other, for example, a first subset of 48 slots is oriented such that each slot's lengthwise direction is perpendicular to an orientation of a second subset of 32 slots. More specifically, in this example, the top plate 103 has eight rows 120 of securing slots 105 (six slots 105 in each row 120, each row 120 being 5 inches apart from a consecutive row 120) arranged such that the slots 105 in each row 120 are lengthwise parallel to an edge 130 of the top plate 103 of the pallet 100. In addition, the top plate 103 has seven columns 115 of securing slots 105 (four slots 105 in some columns 115, five slots 105 in other columns 115, each column 115 being 5 inches apart from a consecutive column 115) arranged such that the slots 105 in each column 115 are lengthwise perpendicular to the edge 130 of the top plate 103. As a result, the columns 115 of slots 105 are perpendicular to the rows 120 of slots 105.

The above-described arrangement provides several potential advantages. For example, because the securing slots 105 on the top plate 103 (to which the load is affixed) are disposed in orientations that vary from one another (e.g., perpendicular to each other), a mechanical advantage arises that ensures that, when straps are secured through the slots 105 of varying orientation across a load, the load so secured will be held in a manner that substantially prevents relative movement between the load and the pallet 100. In addition, due to the relatively large quantity of securing slots 105 dispersed across the top plate 103, loads of various shapes and sizes—even loads of irregular shapes and sizes—may be quickly, easily, and conveniently positioned on the pallet 103 in a manner such that multiple available securing slots 105 are likely to be adjacent to the perimeter of the load and thus may be used to secure the load to the pallet 100. In contrast, with conventional pallets, the securing slots typically are oriented in only a single direction, which tends to make properly securing loads difficult if not impossible. Furthermore, the large quantity of securing slots 105 allows the top plate 103 of the pallet 100 to be partitioned, such that multiple payloads can be segregated from one another while being secured to the pallet 100. Such segregation may allow one payload to be secured to or removed from the pallet 100 without disturbing other payloads that are secured to the pallet 100.

Although the example of FIG. 1 shows a certain number of slots 105 of a certain size and shape disposed in a certain pattern, essentially any other number of slots, size, shape and pattern may be used depending on a desired application. The materials used to construct pallet 100 can be one or more of any materials appropriate for the load to be supported and transported, e.g., wood, metal, plastic, paper, ceramic, a non-flammable material, and/or other materials. In some examples, the pallet 100 is adapted to support a load of up to 25 tons. Such a load rating can allow the pallet 100 to support heavy equipment such as machinery and ammunition.

Figure 2:
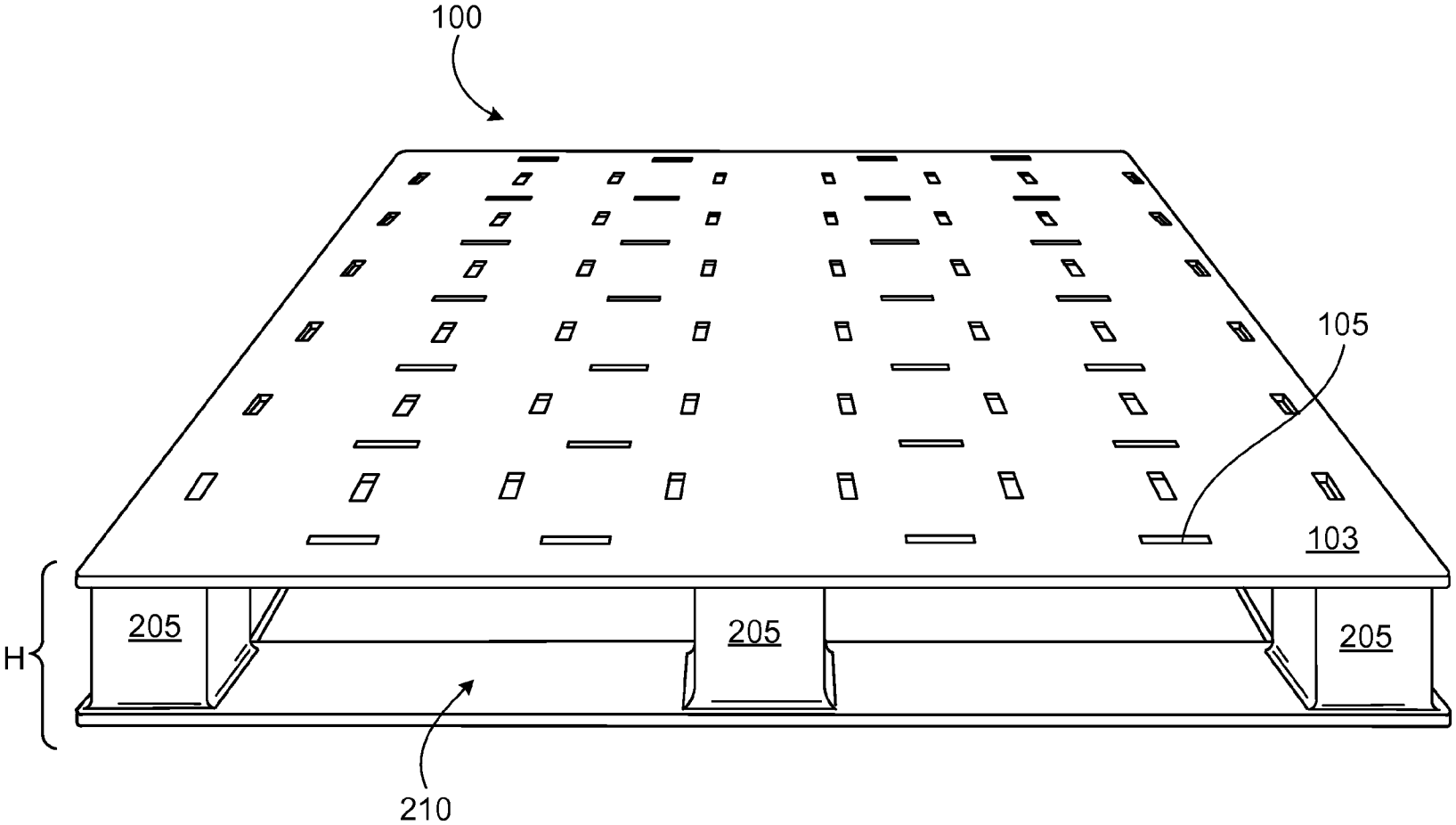
FIG. 2 is a perspective view of the pallet of FIG. 1.

FIG. 2 is a perspective view of the pallet 100. As shown, the pallet's top plate 103 is spaced apart from a base structure 210, which can either be a complete plate or, as shown, a plate having a central void (i.e., a hole in the middle of the plate, as shown in FIG. 4B). The top plate 103 is spaced apart from the base structure 210 by support legs 205, which are each attached to the top plate 103 at one end and attached to the base structure 210 at an opposite end. As shown, the support legs 205 can be formed as square posts or, alternatively, as posts of other shapes, such as cylindrical, rectangular, triangular, or the like. In this example, the pallet 100 includes eight peripheral support legs 205 (one in each corner of the pallet 100 and one at each mid-point of the edges,), although a different quantity of support legs 205 could be used as desired and/or appropriate. Additionally, the pallet 100 includes a center-point support leg 305 (shown in FIG. 3) that extends downward from the center of the top plate 103. In the example shown in FIG. 2, the height H of the palette is five (5) inches, which corresponds to a standard pallet height, but other heights could be used as desired/appropriate.

Figure 3:
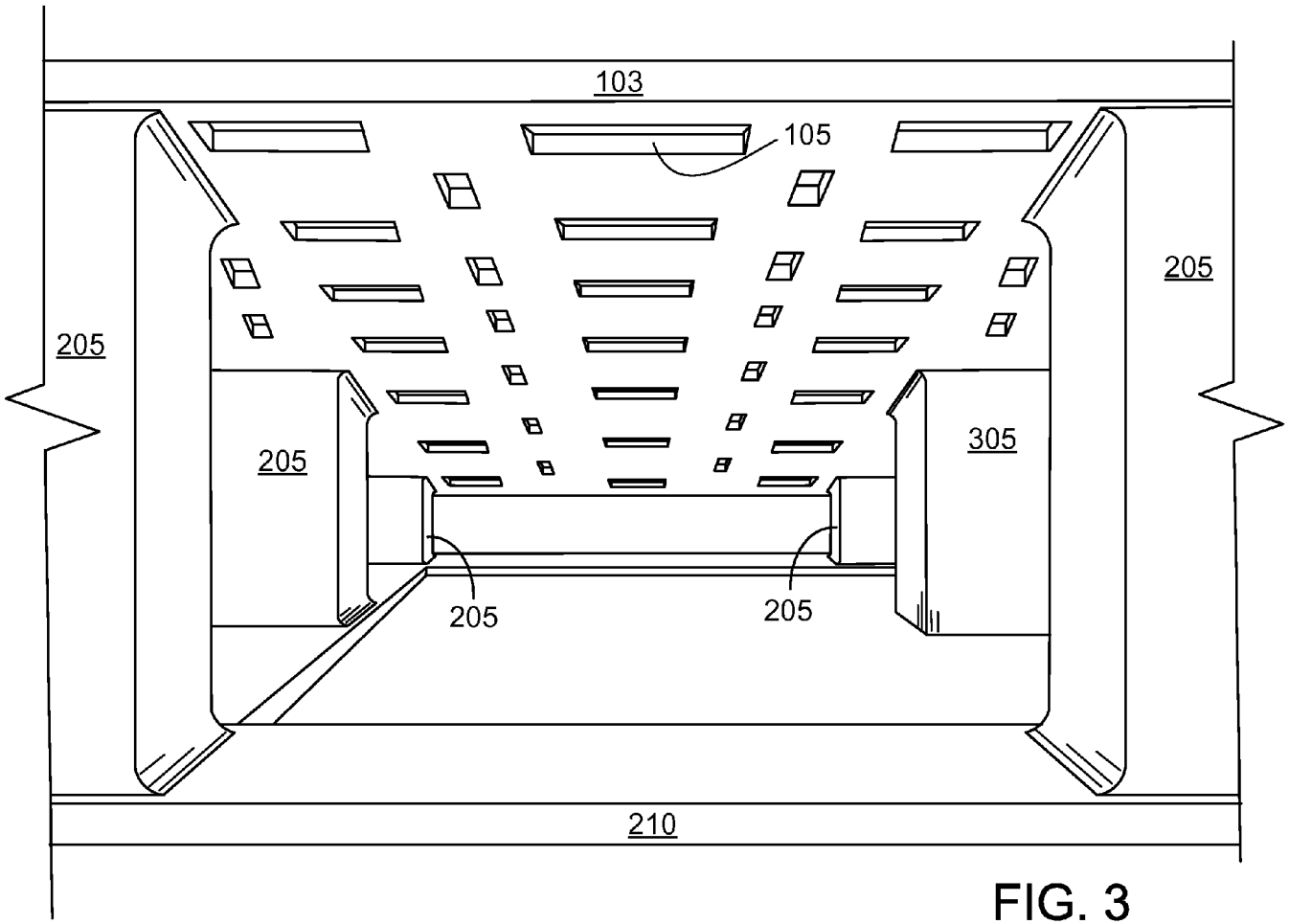
FIG. 3 is a perspective view of a portion of the pallet of FIG. 1, showing an internal structure of the pallet.

FIG. 3 is a perspective view of a portion of the pallet 100, and particularly, a view looking inside the pallet 100 such that the top plate 103 is at the top of the figure and the base structure 210 is at the bottom of the figure. As shown, several of the support legs 205 are visible. The center-point support leg 305 also is visible and from this view it becomes apparent that in this particular example, while joined to the top plate 103, the center-point support leg 305 is not joined to the base structure 210, but rather extends into the base structure's central void (i.e., hole in the middle of the base structure 210) and in fact contacts the ground surface when the pallet 100 is resting on the ground. Thus, the center-point support leg 305 is longer than the surrounding peripheral support legs 205 (e.g., by a length that is approximately equal to the thickness of the base structure 210).

Figure 4A:
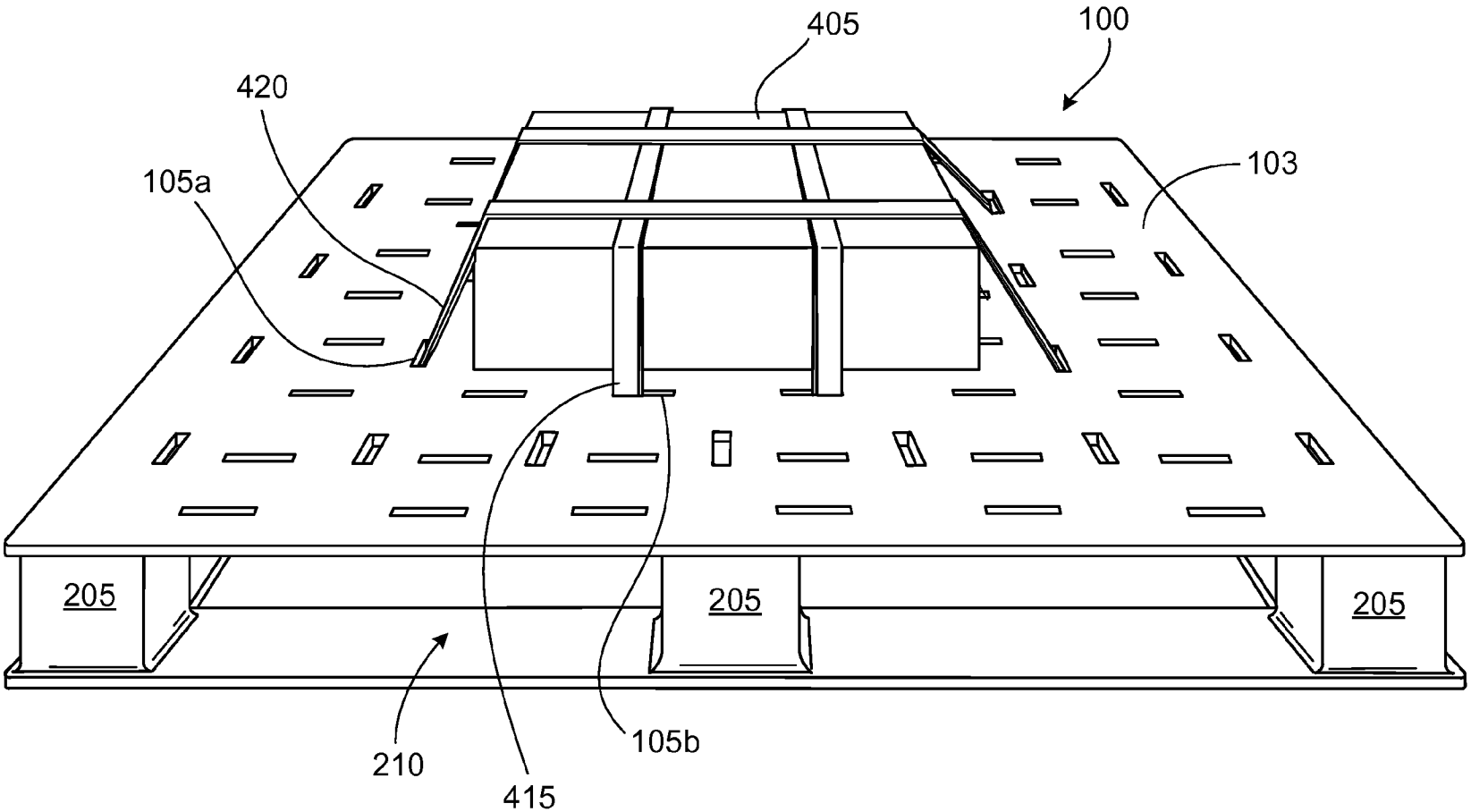
FIGS. 4A and 4B are perspective views of a load secured to the pallet of FIG. 1, as viewed from top and bottom surfaces, respectively, of the pallet.
Figure 4B:
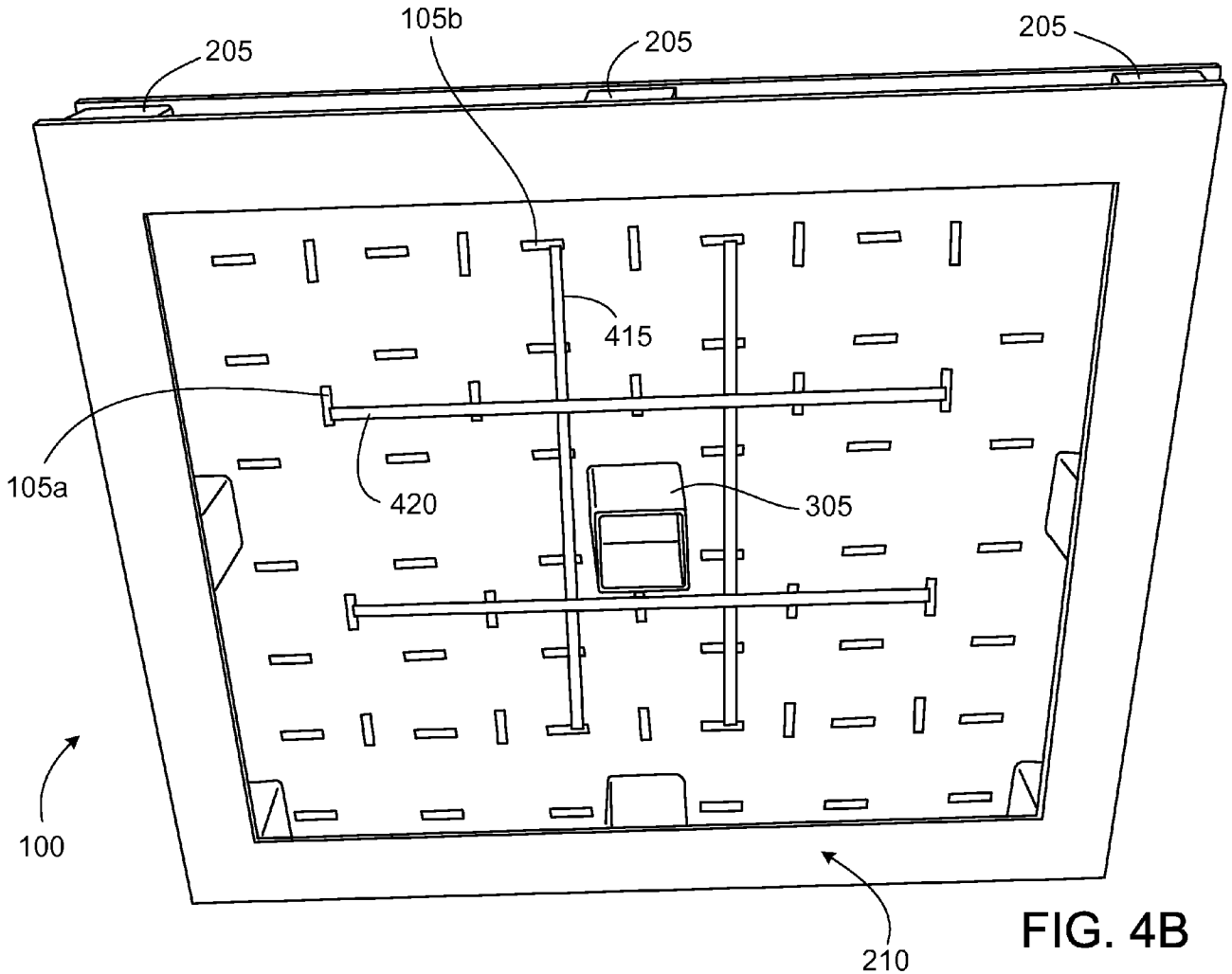

FIG. 4A is a perspective view of the pallet 100, to which a load 405 is secured. As shown, the load 405 sits on top of the top plate 103 and is secured to the pallet 100 by straps 415 and 420 (although bolts could be used instead of or in addition to straps 415 and 420). To better secure the load 405, straps 415 and 420 engage securing slots 105 that vary in orientation from each other, e.g., perpendicular to each other. More specifically, strap 420 engages a slot 105*a* and extends across the load 405 to secure load 405 to the pallet 100. At the same time, strap 415 engages slot a 105*b*, which is perpendicular to slot 105*a*. Because the two slots 105*a* and 105*b* vary in orientation, more particularly, because they are perpendicular to each other, the load 405 may be much more securely fastened to the pallet 100 than would otherwise be possible if the slots 105*a* and 105*b* had the same or similar orientation. As a result, the load 405 is much more likely to be secured to the pallet 100 in a manner that substantially resists any relative movement between the load 405 and the pallet 100. While the load 405 is shown as having a generally rectangular shaped cross-section, the pallet 100 may be used to support and secure loads having a variety of shapes. The straps 415 and 420 may be of the same construction or of a different construction. In some examples, a first end region of the strap 415 and 420 may be fastened to a second end region of the strap 415 and 420 via a hook and loop fastener mechanism disposed along the end regions of the strap 415 and 420.

FIG. 4B is a perspective view of the pallet 100 shown in FIG. 4A except that the pallet 100 in this view has been rotated to its side to expose the underside of the pallet 100. In this view, the slots 105*a* and 105*b* and straps 415 and 420 are visible.

Figure 5:
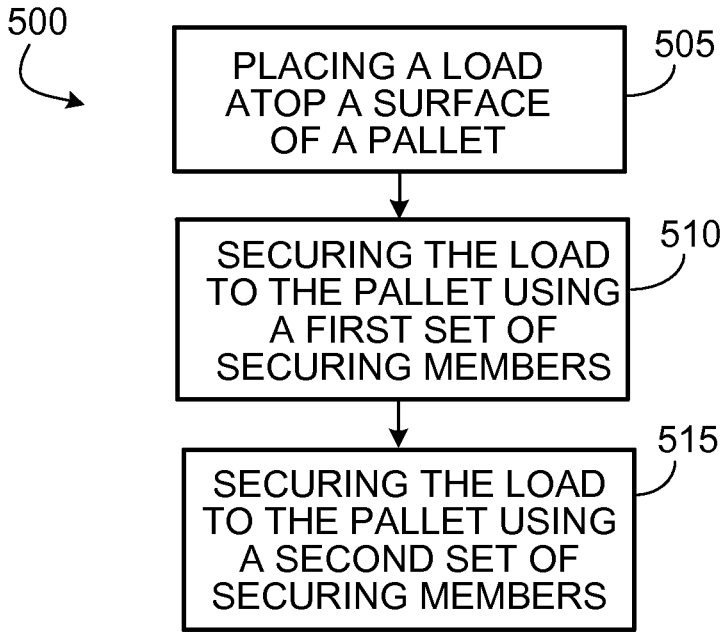
FIG. 5 is a flowchart of an example process for securing a load to a pallet.

FIG. 5 is a flowchart of an example process 500 for securing a load (e.g., the load 405) to a pallet (e.g., the pallet 100). Examples of such a load can include industrial equipment, supplies, large precision instruments, weaponry, and ammunition. At 505, the load is placed atop a surface (e.g., the top plate 103) of the pallet at a desired location. At 510, the load can then be secured to the pallet using a first set of one or more securing members (e.g., the straps 415 and 420). For example, a first set of one or more straps may be passed through a first set of respective slots (e.g., slots oriented lengthwise parallel to an edge of the pallet, such as the slot 105*a*) extending through a top plate of the pallet and then fastened securely around the load. At 515, the load may be further secured to the pallet using a second set of one or more securing members (e.g., the straps 415 and 420). For example, a second set of one or more straps may be passed through a second set of respective slots (e.g., slots oriented lengthwise perpendicular to the edge of the pallet, such as the slot 105*b*) extending through the top plate of the pallet and oriented perpendicular to the first set of slots and then fastened securely around the load. In this manner, the first set of one or more straps can extend across the load in a direction perpendicular to that at which the second set of one or more straps extends across the load. In some examples, the straps extend across the load with respect to each other at angles other than 90 degrees. In some cases, one or more additional loads may be secured to the pallet. In some examples, securing bolts can be used alternatively or in addition to the straps to secure the load to the pallet.

The SMISS pallet system described herein may include one or more other features/aspects. For example, the number of securing slots 105 as well as the number of rows 120 is something that can vary from one model of the SMISS to another model of the SMISS. The slots 105 are configured to accommodate strapping, banding, bolts, ratchet straps, or essentially any other suitable securing mechanism. The slots 105 can be different shapes (rectangular, circular, oval, square, star-shaped, t-slotted, etc.) to accommodate strapping, banding, bolts, ratchet straps, other proprietary fastening systems or essentially any other suitable securing mechanism. In some examples, two or more pallets 100 can be linked together to form a secure flooring for hazardous or uneven terrain. The pallet 100 can be made in a variety of heights, widths, and lengths to accommodate different payloads, storage racks, storage systems, and vehicles. The pallet 100 can be used to secure loads even upside down or during air and space transport. For example, a load can be secured to the pallet 100 while the pallet 100 is oriented right side up, and then the pallet 100 and the secured load may be lifted and turned upside down, sideways, or in an arbitrary direction during transport through the air. The pallet 100 is also reusable. The pallet 100 is environmentally friendly as the pallet 100 can be used thousands of times before the pallet 100 degrades or is damaged through use. The pallet 100 is easily repaired with commonly used tools and processes. The support legs 205, when welded or joined, are welded or joined by placing the pallet 100 in a welding fixture (or jig) that forces the pallet 100 to deform slightly so that when the support legs 205 are joined to the top plate 103 and the base structure 210, and the pallet 100 is removed from the welding jig, the support legs 205 are under some tension around the periphery, which allows for a stronger and more stable pallet 100. Due to the distribution of the support legs 205, the pallet 100 is accessible via forklift, pallet-jack, or skip loader from all four sides instead of from two sides like traditional pallets. For example, components of such support systems may be inserted underneath the top plate 103 of the pallet 100 and between two consecutive support legs 205 from any side of the pallet 100.

Figure 6:
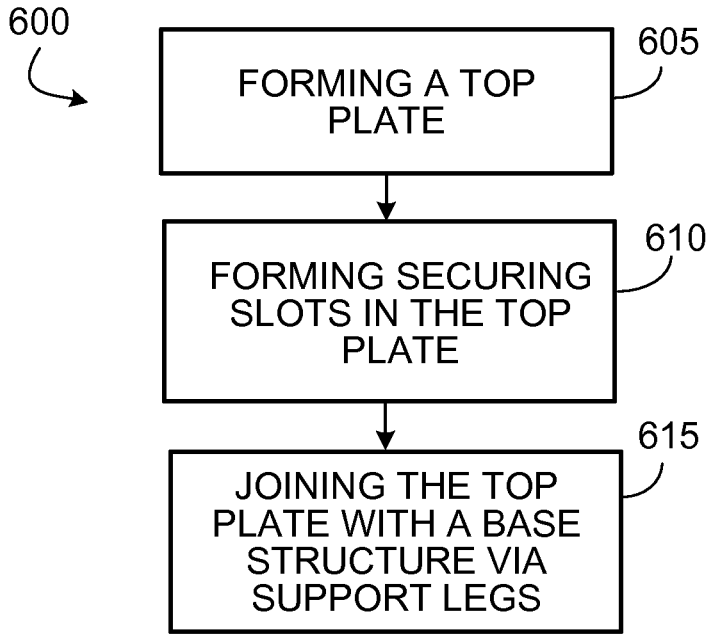
FIG. 6 is a flowchart of an example process for manufacturing a pallet.

FIG. 6 is a flowchart of an example process 600 for manufacturing a pallet (e.g., the pallet 100 as described above). The steps as shown in FIG. 6, and as further described below, need not necessarily be performed in the order indicated. In addition, in appropriate circumstances, two or more steps may be performed in an over-lapping or substantially simultaneous manner.

As shown in FIG. 6, first at 605, a top plate is formed from a plate of material (e.g., steel, aluminum, etc.) of rough dimension. Then, at 610, securing slots (e.g., the slots 105) are formed in the top plate such that a first subset of securing slots are formed to be lengthwise parallel to a first edge (e.g., the edge 130) of the top plate and a second subset of securing slots are formed to be lengthwise perpendicular to the first edge of the top plate. Next, at 615, the top plate with the securing slots formed therein is joined with a base structure (e.g., the base structure 210) via a plurality of support legs (e.g., the support legs 205 and the center-point support leg 305). The support legs are disposed between the top plate and the base structure in an arrangement that accommodates engagement of the pallet with a standard jacking device. For example, due to the distribution of the support legs, the pallet is accessible via the jacking device from all four sides instead of from two sides like traditional pallets.

In a specific implementation, the process 600 can include additional details. As described above, a plate of material of rough dimension (e.g., steel, aluminum, etc.) is obtained for the pallet. A desired number and pattern of the securing slots is cut out with a CNC (computer numerically controlled) Plasma Table/Waterjet/Laser/mill (for example, as described above with regard to FIG. 1), and then the plate of material is cut to the exact dimensions required (for example, 40" by 48" for the pallet 100). A square stock for the support legs is then cut out. A square stock for the center support leg (slightly longer than the other support legs to accommodate the thickness of a bar stock that will be used to form the base structure) is cut out. The bar stock (e.g., a ¼" thick bar stock) is cut in lengths to link all of the peripheral support legs together once welded. The peripheral support legs are placed at the edges of the pallet and joined to the pallet via one or more processes including SMAW (Stick Welding), GTAW (TIG Welding), FCAW (MIG Welding), ultrasonic joining, chemical adhesion, or another joining process. The center-point support leg is placed at the center of the pallet and joined via the above-mentioned methods to the pallet.

The pallet is then placed in a jig and/or a clamp so that the top plate of the pallet is facing down and the support legs are oriented upright. The bar stock is placed between the top plate and the welding table (or fixture) so that the corners of the top plate slightly bow upwards (e.g., by approximately ¼" at each corner) towards the center-point support leg of the pallet. Once the pallet is bowed, the pallet is clamped thoroughly, and then the bar stock is joined via the above-mentioned methods to the peripheral support legs and the center-point support leg. The pallet is removed from the fixture and allowed to relax. The tension created by forcefully deforming the pallet at each corner creates a slight prestress in the pallet which prevents it from deforming under extreme loads. For example, the pallet manufactured using the process 500 can withstand loads of up to about 25 tons. A primer and paint or other corrosion resistant or protective coating may then be applied to all or a portion of the pallet as desired.

Particular embodiments of the subject matter have been described. Other embodiments are within the scope of the following claims. For example, the actions recited in certain claims can be performed in a different order and still achieve desirable results. As one example, the processes depicted in the accompanying figures do not necessarily require the particular order shown, or sequential order, to achieve desirable results.

What is claimed is:

1. A pallet comprising:

a top plate;

a base structure spaced apart from the top plate; and a plurality of support legs that are attached to the top plate at respective first ends, at least a portion of the plurality of support legs being attached to the base structure at respective second ends, the plurality of support legs being disposed between the top plate and the base structure in an arrangement that accommodates engagement of the pallet with a standard jacking device; wherein the top plate defines a plurality of securing slots extending through the top plate, wherein a first subset of the plurality of securing slots is oriented lengthwise parallel to a first edge of the top plate and a second subset of the plurality of securing slots is oriented lengthwise perpendicular to the first edge of the top plate, and wherein a distance between adjacent lengthwise parallel securing slots is substantially equal to a distance between adjacent lengthwise perpendicular securing slots, wherein the plurality of support legs includes a central support leg that (a) is connected to the top plate substantially at a central-point of the top plate, and (b) is unconnected to the base structure.

2. The pallet of claim 1, wherein the pallet comprises at least one of steel or aluminum.

3. The pallet of claim 1, wherein the top plate is rectangular in shape with approximate dimensions of one of the following: 48 inches by 40 inches, 48 inches by 48 inches, 60 inches by 36 inches, 36 inches by 36 inches, and 24 inches by 24 inches.

4. The pallet of claim 1, wherein the base structure comprises a rectangular plate defining a central void.

5. The pallet of claim 4, wherein the central void has a circular or rectangular shape.

6. The pallet of claim 1, wherein four of the plurality of support legs are disposed near respective corners of the top plate and another four of the plurality of support legs are disposed near midpoints of respective edges of the top plate.

7. The pallet of claim 1, wherein the central support leg extends into a central void defined by the base structure.

8. The pallet of claim 1, wherein each of the plurality of securing slots has a length that is greater than a width of the respective securing slot.

9. The pallet of claim 8, wherein each of the plurality of securing slots is rectangular in shape, having a length dimension of about two inches and a width dimension of about 0.5 inch.

10. The pallet of claim 1, wherein the first subset of the plurality of securing slots comprises at least eight rows of securing slots evenly spaced across the top plate, and wherein the second subset of the plurality of securing slots comprises at least seven rows of securing slots evenly spaced across the top plate.

11. The pallet of claim 10, wherein the second subset of the plurality of securing slots is oriented perpendicular to the first subset of the securing slots.

12. The pallet of claim 1, wherein the central support leg is longer than other support legs by an amount corresponding to a thickness of the base structure.

13. The pallet of claim 1, wherein the central support leg is configured to rest on the ground when the pallet is in use.

14. A method of manufacturing a pallet, the method comprising:

forming a top plate defining a plurality of securing slots, wherein a first subset of the plurality of securing slots is oriented lengthwise parallel to a first edge of the top plate and a second subset of the plurality of securing slots is oriented lengthwise perpendicular to the first edge of the top plate, wherein a row of lengthwise perpendicular slots is formed between adjacent rows of lengthwise parallel slots and a row of lengthwise parallel slots is formed between adjacent rows of lengthwise perpendicular slots; and joining the top plate with a base structure via a plurality of support legs, the plurality of support legs being disposed between the top plate and the base structure in an arrangement that accommodates engagement of the pallet with a standard jacking device, wherein the plurality of support legs includes a central support leg that (a) is connected to the top plate substantially at a central-point of the top plate, and (b) is unconnected to the base structure.

15. The method of claim 14, wherein four of the plurality of support legs are disposed near respective corners of the top plate and another four of the plurality of support legs are disposed near midpoints of respective edges of the top plate.

16. The method of claim 14, wherein the central support leg extends downward from the top plate and through a central void defined by the base structure.

17. The method of claim 14, wherein each of the plurality of securing slots has a length that is greater than a width of the respective securing slot.

18. The method of claim 14, wherein the pallet comprises at least one of steel or aluminum.

19. The method of claim 14, wherein the central support leg is longer than other support legs by an amount corresponding to a thickness of the base structure.

20. The method of claim 14, wherein the central support leg is configured to rest on the ground when the pallet is in use.

* * * * *